US007530245B2

(12) United States Patent
Fan

(10) Patent No.: US 7,530,245 B2
(45) Date of Patent: May 12, 2009

(54) DOOR LOCK

(75) Inventor: Fangchang Fan, Tianjin (CN)

(73) Assignee: Eversafety Precision Industry (Tianjin) Co., Ltd., Tianjin (CN)

( * ) Notice: Subject to any disclaimer, the term of this patent is extended or adjusted under 35 U.S.C. 154(b) by 54 days.

(21) Appl. No.: 11/854,539

(22) Filed: Sep. 12, 2007

(65) Prior Publication Data

US 2009/0064738 A1 Mar. 12, 2009

(51) Int. Cl.
*E05B 65/06* (2006.01)

(52) U.S. Cl. ..... 70/134; 70/467; 70/471; 70/483; 292/359

(58) Field of Classification Search ..... 70/134, 70/467, 468, 471, 476, 481–483, 486, 487, 70/150, 153; 292/359
See application file for complete search history.

(56) References Cited

U.S. PATENT DOCUMENTS

| | | | | | |
|---|---|---|---|---|---|
| 396,571 | A * | 1/1889 | Iddings et al. | 292/359 |
| 861,421 | A * | 7/1907 | Young | 70/379 R |
| 1,760,394 | A * | 5/1930 | Best et al. | 292/359 |
| 1,956,388 | A * | 4/1934 | Kalina | 70/416 |
| 2,117,947 | A * | 5/1938 | De Rome et al. | 292/352 |
| 2,497,329 | A * | 2/1950 | Smith et al. | 292/169.14 |
| 2,525,340 | A * | 10/1950 | Clark | 292/359 |
| 2,655,026 | A * | 10/1953 | Syler | 70/469 |
| 2,733,089 | A * | 1/1956 | Grevengoed | 292/1 |
| 2,929,651 | A * | 3/1960 | Friedman et al. | 292/228 |
| 3,815,390 | A * | 6/1974 | Stoia | 70/134 |
| 3,919,867 | A * | 11/1975 | Lipschutz et al. | 70/186 |
| 4,055,361 | A * | 10/1977 | Moses | 292/359 |
| 5,072,976 | A * | 12/1991 | Meszaros | 292/207 |
| 5,364,139 | A * | 11/1994 | Bergen et al. | 292/169 |
| 5,421,074 | A * | 6/1995 | Moore | 29/401.1 |
| 5,826,924 | A * | 10/1998 | Huang | 292/359 |
| 5,901,590 | A * | 5/1999 | Lai | 70/416 |
| 5,909,919 | A * | 6/1999 | Wang | 292/359 |
| 6,135,512 | A * | 10/2000 | Galvin | 292/163 |
| 6,145,358 | A * | 11/2000 | Wu | 70/467 |
| 6,729,169 | B2 * | 5/2004 | Moore | 70/472 |
| 6,793,254 | B1 * | 9/2004 | Galvin | 292/163 |
| 6,912,882 | B1 * | 7/2005 | Alonso | 70/472 |
| 2005/0039504 | A1 * | 2/2005 | Smith et al. | 70/134 |
| 2007/0266747 | A1 * | 11/2007 | Rafferty et al. | 70/134 |

* cited by examiner

*Primary Examiner*—Suzanne D Barrett

(57) ABSTRACT

A door lock includes outer assemblies, latch assemblies and inner assemblies. The inner assemblies has a turning switch, fixing bolts, an interior rose and a detent device that includes an inner plate, a stop plate, a stop seat, a rotating spring, a retaining spring and a sprag. By pressing down the stop plate as the latch bolt is in a casing, a protruding block of the stop seat is engaged with a protruding member of the stop plate. The spindle can not rotate backward and maintains in an unlocked state. After the stop plate is pressed upward, the turning switch returns to a locked state and the latch bolt extends out of the casing. Therefore, the detent device can keep the latch bolt in the casing and keep the lock in the unlocked state.

11 Claims, 5 Drawing Sheets

DOOR LOCK

BACKGROUND OF THE INVENTION

1. Field of the Invention

The present invention relates to a door lock, and more particularly to a door lock with a detent device.

2. The Prior Arts

Nowadays, door locks installed in room doors of houses and hotels are mostly mechanical cylindrical locks. For the cylindrical lock, a key is used to unlock the door from outside. The key drives a spindle of the lock body to retract a latch bolt in a casing so that the door is unlocked. However, once the key is released, the latch bolt extends out of the casing at once and the lock returns to a locked state again. Moreover, to open the door from inside, a turning switch installed on the door is turned. By turning the turning switch, the spindle of the lock body drives the actuating member to retract the latch bolt into the casing, thereby unlocking the door. Similarly, when the turning switch is released, the latch bolt extends out of the casing at once and the lock returns to the locked state again. A door lock of a room, such as a conference room, does not need to lock the door frequently. If the door is locked right after the people get in or get out of the room, it is very inconvenient. Therefore, in this situation, the door lock should be kept in the unlocked state so that it is convenient for the people to enter or leave the room.

SUMMARY OF THE INVENTION

A primary objective of the present invention is to provide a door lock with a detent device. The detent device keeps a latch bolt of the door lock in a casing of the lock. Thus, the door lock is maintained in an unlocked state and it is convenient for people to open and close the door frequently. The latch bolt extends out of the casing only when the detent device is operated to make the door lock back to a locked position. Then, it needs a key or a turning switch to unlock the door.

The door lock according to the present invention includes outer assemblies, latch assemblies and inner assemblies. The inner assemblies include a turning switch, fixing bolts, an interior rose and a detent device that includes an inner plate, a stop plate, a stop seat, a rotating spring, a retaining spring and a sprag.

The inner plate is provided with a guiding track projected from the surface of the upper portion thereof. The stop plate includes a protruding member at a middle portion thereof, protrusions at a middle portion thereof and an opening at a lower portion thereof. The protruding member is perpendicular to the stop plate; and the protrusions are corresponding to the guiding track so that the stop plate is capable of sliding along the guiding track up and down. The stop seat, a hollow stepped cylinder, includes a front cylinder having a front surface formed with a positioning surface with a protruding block on the top, and a spring holding member extended axially from the edge of the front cylinder on the opposing side to the protruding block. The rotating spring engaged with the stop seat includes two ends formed with a spring arm respectively and the spring arms are disposed on two sides of the spring holding member respectively. The retaining spring is located in the hollow portion of the stop seat, and the retaining spring and the stop seat are engaged with the revolving axis of the turning switch. The sprag is pressed on the retaining spring for fixing and positioning the retaining spring.

Further, the disk-shaped inner plate includes two notches oppositely formed on the edge, which are assembled with the stop plate at the upper and lower ends.

Further, the interior rose has a disk shape corresponding to the inner plate and includes two notches formed in two opposite positions on the edge respectively. The inner plate is fitted in the interior rose, and the inner surface of the interior rose is in contact with the outer surface of the inner plate. The notches formed on the inner plate are corresponding to the notches formed on the interior rose.

Further, a protruding piece perpendicular to a body surface of the inner plate is formed on the lower portion of the inner plate and passes through the opening of the stop plate.

Further, the stop plate is provided with a bulge on the surface contacted with the inner plate, and the inner plate is provided with two indentations arranged in vertical direction and corresponding to the bulge. Before the stop plate is pressed, the bulge of the stop plate is engaged with the higher indentation of the inner plate. After the stop plate is pressed downward to be engaged with the stop seat, the bulge of the stop plate is engaged with the lower indentation of the inner plate.

When the latch bolt according to the present invention is retracted in unlocking state, the stop plate is pressed down, the protruding member of the stop plate is engaged with the protruding block of the stop seat, and the stop seat is coupled with the turning switch. Thus, the spindle of the outer assemblies can not rotate backward and the lock is maintains in the unlocked state. Therefore, after the key or the turning switch is released, the latch bolt does not retract into the casing and the door lock is kept in the unlocked state. Further, after the stop plate is pushed upward to the upper end position, the turning switch returns to the original position and the latch bolt extends out of the casing. While unlocking the door without need for keeping the door in the unlocked state, it is possible that the stop plate accidentally slides downward due to gravity and is engaged with the stop seat. The lock is unintentionally kept in the unlocked state and the latch bolt can not extend out of the casing. The solution of the present invention is to provide the stop plate with a bulge and provide the inner plate with two indentations corresponding to the bulge. Also, the retaining spring provides an elastic force for fixing the stop plate between the stop seat and the inner plate. Thus, the stop plate can not slide up and down unless an external force is applied thereon, and the sliding of the stop plate due to gravity is also prevented.

Accordingly, the advantages of the lock according to the present invention are summarized as follows. When the latch bolt of the door lock is in the unlocked position, the detent device of the door lock can keep the latch bolt to be retracted in the casing of the lock and the door lock is kept in the unlocked state. Thus, it is convenient for people to get in and get out of the door frequently. Also, the door lock according to the present invention is easy, convenient and reliable to use.

BRIEF DESCRIPTION OF THE DRAWINGS

The present invention will be apparent to those skilled in the art by reading the following detailed description of a preferred embodiment thereof, with reference to the attached drawings, in which:

FIG. 5 is a side cross-sectional view showing the door lock according to the present invention in the locked state and the detent device in the original position of.

DETAILED DESCRIPTION OF THE PREFERRED EMBODIMENT

Figure 1:
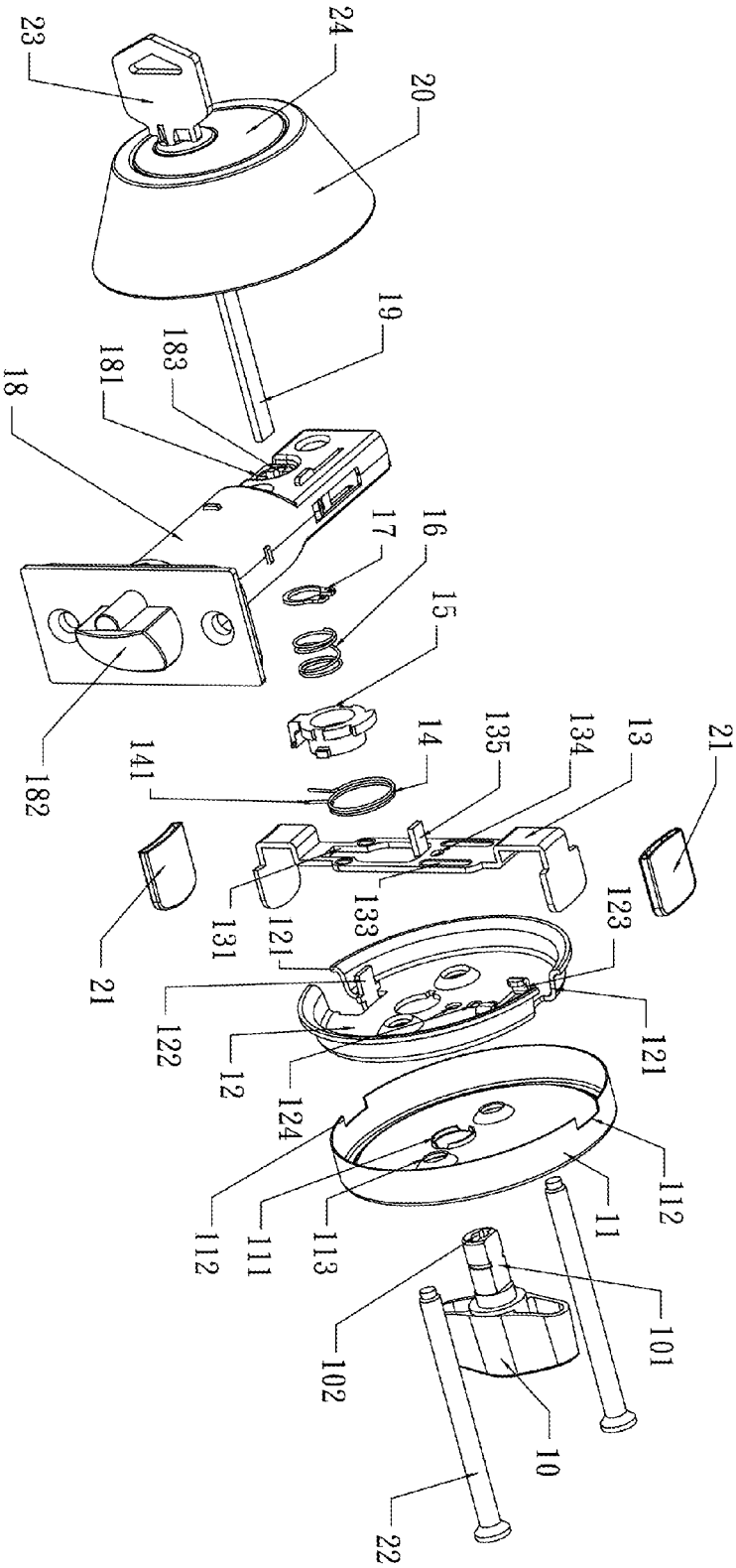
FIG. 1 is an exploded perspective view showing a door lock according to the present invention.

With reference to FIG. 1, which is an exploded perspective view of a door lock according to the present invention, the door lock includes outer assembles, latch assemblies 18 and inner assemblies. The outer assemblies include a key 23, a keyway 24, a cylinder 20, and a spindle 19. The inner assemblies include a turning switch 10, fixing bolts 22, an interior rose 11, and a detent device that includes an inner plate 12, a stop plate 13, a stop seat 15, a rotating spring 14, a retaining spring 16 and a sprag 17.

The latch assemblies 18 of the door lock according to the present invention include an actuating member 181 and a common beveled latch bolt 182. One end of the spindle 19 of the outer assemblies is connected with the keyway 24, and the other end of the spindle 19 passes through a corresponding pivot hole 183 of the latch assemblies 18 and is inserted in a hole 102 formed on the center of the turning switch 10. Accordingly, when the key 23 inserted in the keyway 24 or the turning switch 10 is turned to rotate the spindle 19. Moreover, the rotated spindle 19 drives an actuating member 181 disposed in the latch assemblies 18 to retract the latch bolt 182 into the casing (the moving process of the conventional beveled latch bolt 182 is not described in detail here).

Furthermore, the detent device is disposed between the latch assemblies 18 and the inner assemblies of the door. The inner assemblies also include the disk-shape interior rose 11, the center of which is formed with a central hole 111 for the turning switch 10 to pass through. Two notches 112 are respectively formed on two opposite positions on the edge of the interior rose 11. Moreover, the inner plate 12, the stop plate 13, the stop seat 15, the rotating spring 14, the retaining spring 16 and the sprag 17 of the detent device are disposed between the interior rose 11 and the latch assemblies 18 in order.

With reference to FIG. 1, the inner plate 12 according to the present invention has a disk shape corresponding to the interior rose 11 and includes two notches 121 formed oppositely on the edge and corresponding to the notches 112 of the interior rose 11. A protruding piece 122 is formed on and perpendicular to the surface of the inner plate 12, and is positioned above the lower notch 121. Also, a guiding track 123 is formed on the surface of the inner plate 12 and is positioned under the higher notch 121. The inner plate 12 is fitted in the interior rose 11, and the inner surface of the interior rose 11 is in contact with the outer surface of the inner plate 12. Moreover, the notches 121 of the inner plate 12 are respectively corresponding to the notches 112 of the interior rose 11 so that the stop plate 13 can be engaged with the notches 121 of the inner plate 12 and the notches 112 of the interior rose 11. Furthermore, the center of the inner plate 12 includes a central hole for the turning switch 10 to pass through.

Figure 4:
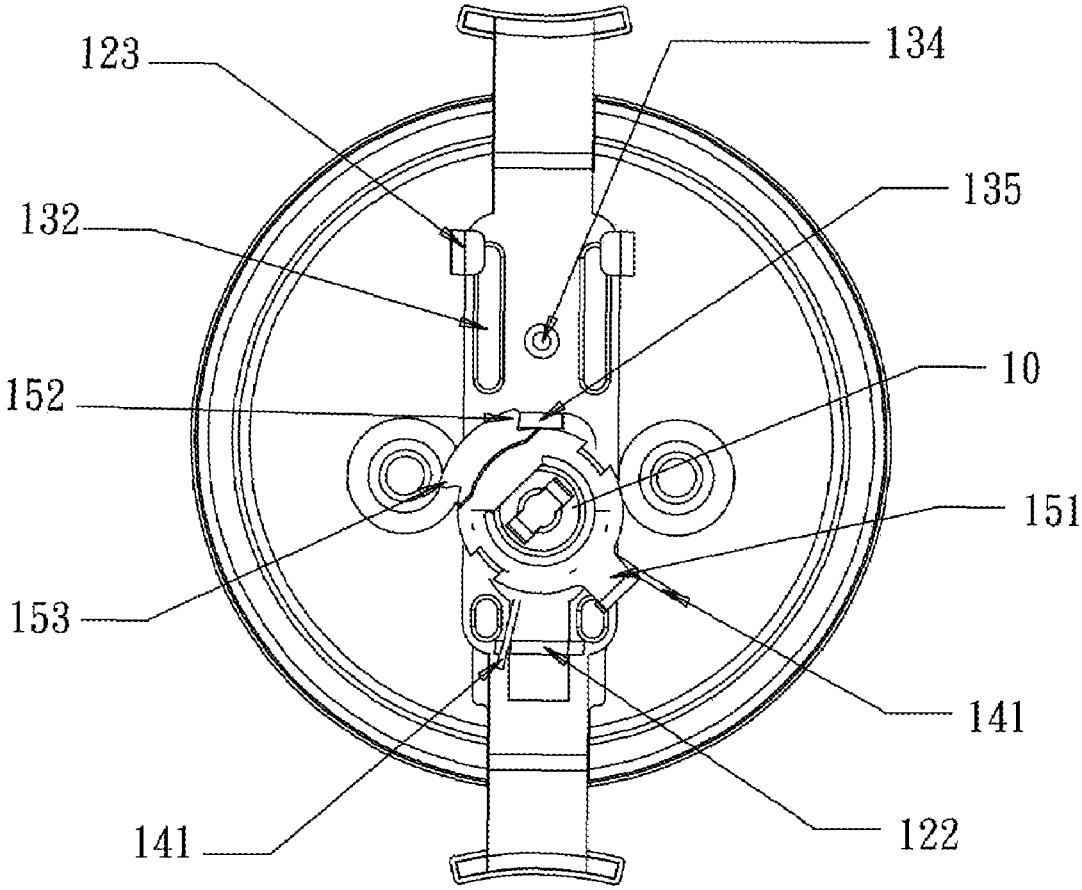
FIG. 4 is a schematic view showing the door lock according to the present invention in an unlocked state and the detent device in a working position.

The upper and lower ends of the stop plate 13 are respectively bended to form a horizontal pressing surface covered by a rubber cover 21 so that the stop plate 13 can be operated easily. Also, the middle of the stop plate 13 includes a protruding member 135 that is perpendicular to the stop plate 13. Moreover, two elongated protrusions 133 located above the protruding member 135 are symmetrically formed in vertical direction on the surface of the stop plate 13. Also, an opening 131 located under the protruding member 135 is formed on the stop plate. With reference to FIG. 4, for installing the stop plate 13, the upper and lower ends of the stop plate 13 are respectively positioned in the notches 121 of the inner plate 12, and two elongated protrusions 133 of the stop plate 13 are engaged with the guiding track 123 of the inner plate 12 so that the stop plate 13 can slide along the guiding track 123 up and down. Moreover, the protruding piece 122 formed on the inner plate 12 extends through the opening 131, thereby defining the moving range of the stop plate 13.

Figure 2:
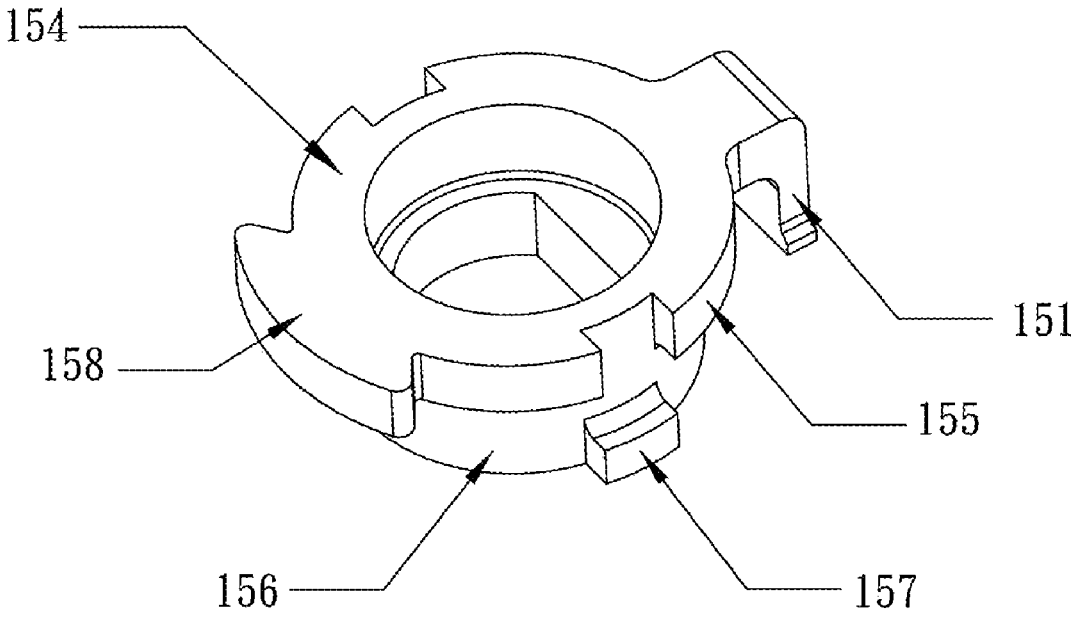
FIG. 2 is a perspective view showing a stop seat of the door lock according to the present invention.
Figure 3:
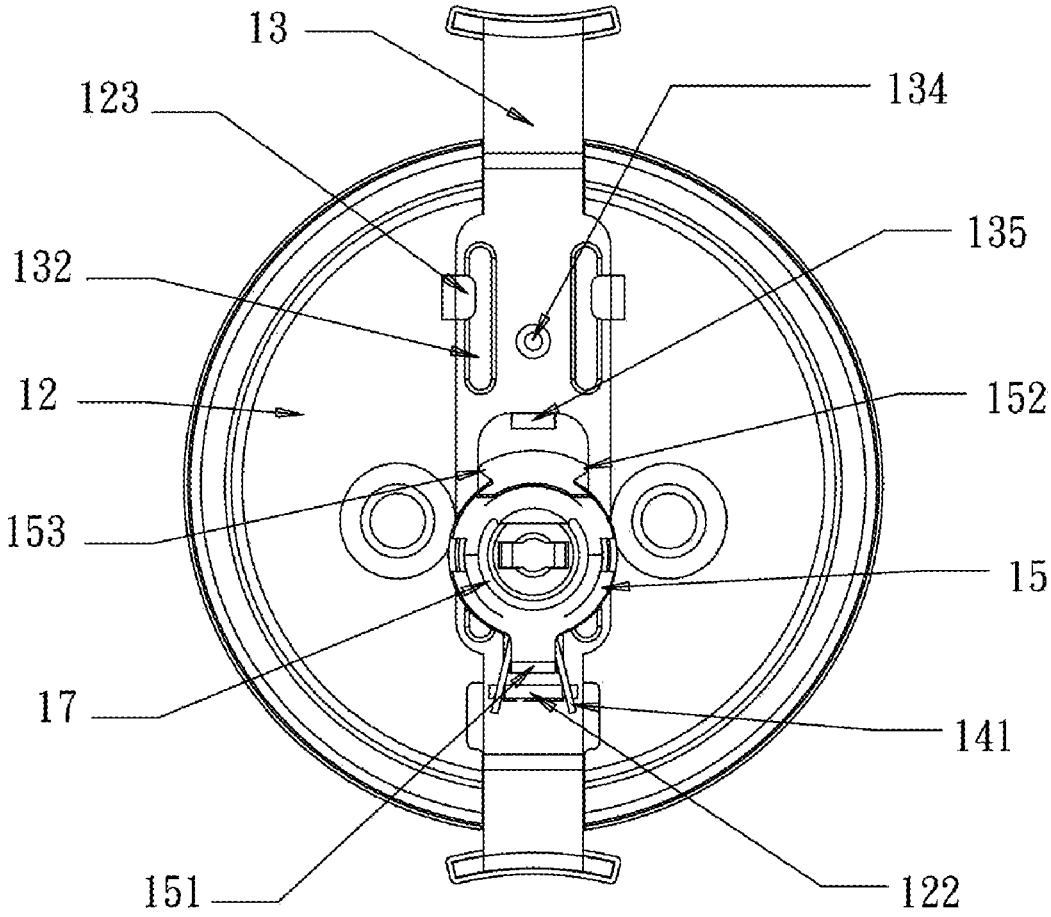
FIG. 3 is a schematic view showing the door lock according to the present invention in a locked state and a detent device in an original position.
Figure 5:
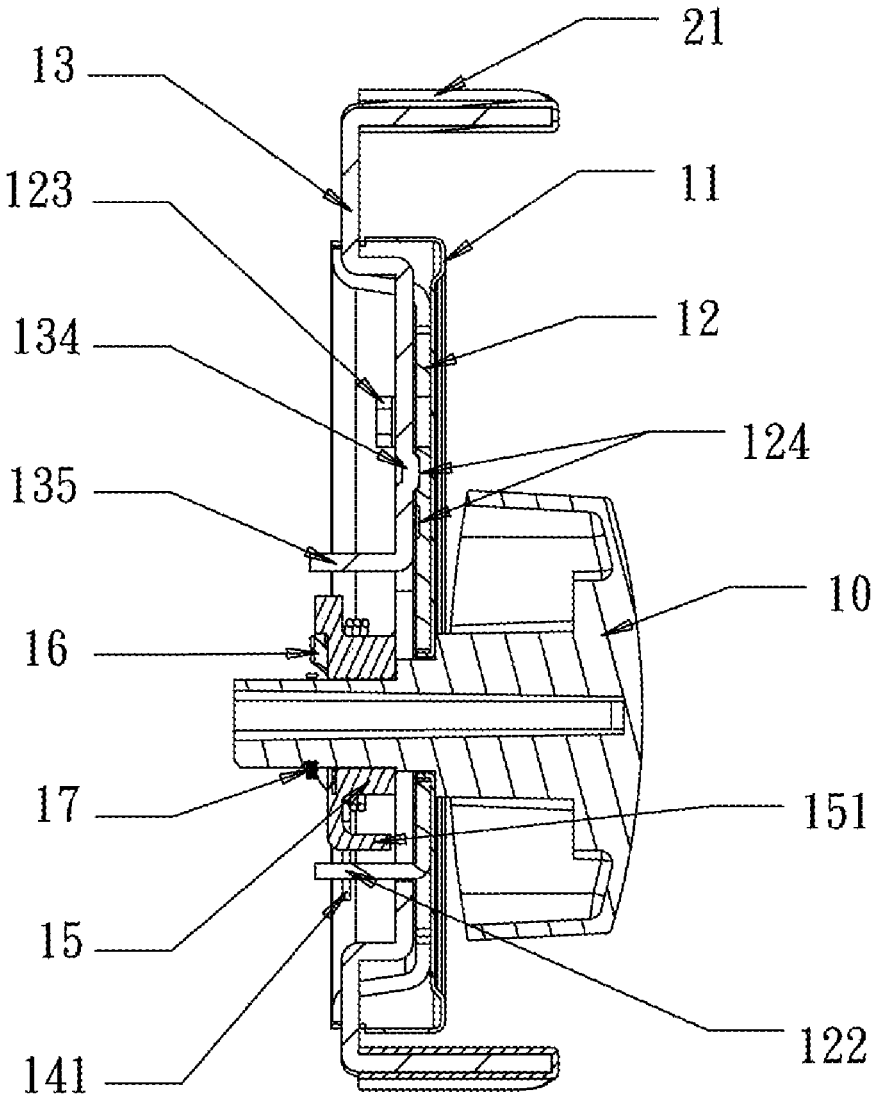

Referring to FIGS. 1 and 2, the stop seat 15, a hollow stepped cylinder, includes a hollow portion engaged with the assembly surface 101 of a revolving axis of the turning switch 10. The front surface of the front cylinder 155 of the stop seat 15 is a positioning surface 154, and the front cylinder 155 is formed with a protruding block 158 on the top of the positioning surface 154. The two side edges of the protruding block 158 are formed with two top ends, which are a first assembling point 152 and a second assembling point 153 (with reference to FIG. 3). Moreover, a spring holding member 151 on the opposing side to the protruding block 158 is formed on the edge of the front cylinder 155 axially, and the stop seat 15 also includes a protrusion 157 on the back cylinder 156. Accordingly, a rotating spring 14 is engaged with the stop seat 15 and positioned between the protrusion 157 and the spring holding member 151. Also, with reference to FIG. 3 and FIG. 4, spring arms 141 respectively extending from the two ends of the spring 14 are positioned at the two sides of the spring holding member 151. Moreover, with reference to FIG. 5, in installing of the stop seat 15, the stop seat 15 engaged with the rotating spring 14 is positioned at the opening 131 of the stop plate 13, the back surface of the stop seat 15 is in contact with the front surface of the stop plate, and the protruding block 158 of the stop seat 15 is positioned right under the protruding member 135 of the stop plate 13.

Moreover, the detent device according to the present invention also includes a retaining spring 16 placed in the hollow portion of the stop seat 15. The retaining spring 16, together with the stop seat 15, are engaged with the revolving axis of the turning switch 10. Furthermore, the detent device according to the present invention includes a sprag 17, which is connected with the retaining spring 16 for fixing and restricting it. The sprag 17 in the embodiment of the present invention has a "C" shape. In assembly of the detent device of the lock device according to the present invention, the turning switch 10 passes through the central holes of the interior rose 11 and the inner plate 12, the opening 131 of the stop plate 13, the stop seat 15, the retaining spring 16 and the sprag 17. The interior rose 11, the inner plate 12 and the latch assemblies 18 are respectively formed with screw holes. The fixing bolts 22 passes through the screw holes mentioned above and fixing holes of the outer assemblies, thereby completing the installation of the door lock.

With reference to FIG. 4, when the stop seat 15 is driven to rotate by the turning switch 10, the latch bolt 182 of the door lock is retracted to the unlocked position. When the stop plate 13 of the detent device is pressed downward, the stop plate 13 moves along the guiding track 123 downward and the protruding member 135 of the stop plate 13 is engaged with the first assembling point 152. Thus, the stop plate 13 can not move upward or downward. Meanwhile, the engagement of the protruding member 135 and the first assembling point 152 prevents the stop seat 15 from rotating to drive the latch bolt 182 back to the locked state. Accordingly, since the protruding member 135 can prevent the stop seat 15 from rotation, the latch bolt 182 is maintained in the unlocked position. Thus, it is convenient for the people to enter or leave the room through the unlocked door.

Moreover, with reference to FIG. 4, the two spring arms 141 of the rotating spring 14 are respectively positioned at both sides of the spring holding member 151. When the stop seat 15 is turned to the unlocked position, one of the spring arms 141 is also driven to move by the spring holding member 151 of the stop seat 15. Thus, the angle between the spring arms 141 increases. From above all, the stretched spring arms 141 can provide an elastic force to resume the rotating spring 14 back to the un-stretched state and to rotate the stop seat 15 back to the locked position. When the stop plate 13 is pushed upward, the protruding member 135 of the stop plate 13 is forced to be disengaged from the first assembling point 152 of the stop seat 15. Thus, the stop plate 13 then slides upward. At the same time, the elastic force provided by the rotating spring 14 rotates the stop seat 15 back to the locked position, so the latch bolt 182 can extend out of the casing.

Furthermore, with reference to FIG. 4, in some situations, the door is unlocked but does not need to be kept in the unlocked state. However, when the turning switch 10 is turned to the unlocked state, it is possible that the stop plate 13 unintentionally slides down due to gravity and the protruding member 135 is engaged with the first assembling point 152. Thus, the door lock is accidentally kept in the unlocked state and the latch bolt 182 can not extend out of the casing. In order to prevent this unintentional situation, the stop plate 13 according to the embodiment of the present invention is provided with a bulge 134 on the surface contacted with the inner plate 12, and the inner plate 12 is provided with two indentations 124 disposed in vertical direction corresponding to the bulge 134. Before the stop plate 13 is pressed, the bulge 134 of the stop plate 13 is engaged with the higher indentation 124 of the inner plate 12. After the stop plate 13 is pressed and engaged with the stop seat 15, the bulge 134 of the stop plate 13 is engaged with the lower indentation 124 of the inner plate 12. Therefore, the engagement of the bulge 134 and the indentation 124 can prevent the stop plate 13 from unintentional sliding caused by gravity. Moreover, the retaining spring 16 according to the present invention provides an elastic force for fixing the stop plate 13 between the stop seat 15 and the inner plate 12. The retaining spring 16 presses the stop plate 13 toward the inner plate 12, and the friction force can prevent the stop plate 13 from sliding down caused by gravity. Thus, the stop plate 13 will not unintentionally slide down unless an external force is applied thereon.

Accordingly, when the door lock according to the present invention is turned to the unlocked state, the stop plate 13 can keep the latch bolt 182 in the casing and keep the door lock in the unlocked state. Thus, the door lock according to the present invention can provide great convenience for people to get in and get out of the door in special occasions. Also, the door lock is convenient, reliable and easy to use.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A door lock, comprising outer assemblies, latch assemblies and inner assemblies including a turning switch, fixing bolts, an interior rose and a detent device, wherein the detent device comprises:

an inner plate including a guiding track projected from a surface of an upper portion thereof, a stop plate including an opening at a lower portion thereof, a protruding member perpendicular to the stop plate at a middle portion thereof, and elongated protrusions corresponding to the guiding track at an upper portion thereof, thereby making the stop plate capable of sliding along the guiding track up and down;

a stop seat, a hollow stepped cylinder, including a front cylinder having a positioning surface disposed at a front surface thereof, a protruding block disposed at the edge thereof, and a spring holding member projected axially from the edge thereof on the opposing side to the protruding block;

a rotating spring engaged with the stop seat and including two ends formed with a spring arm respectively and disposed at both sides of the spring holding member respectively;

a retaining spring disposed in a hollow portion of the stop seat and engaged with a revolving axis of the turning switch together with the stop seat, and a sprag pressed on the retaining spring for fixing and positioning the retaining spring.

2. The door lock as claimed in claim 1, wherein the disk-shaped inner plate includes two notches oppositely formed on the edge thereof, thereby being engaged with both ends of the stop plate.

3. The door lock as claimed in claim 2, wherein the interior rose has a disk shape corresponding to the inner plate and includes two notches formed in two opposite positions on the edge thereof respectively; the inner plate is fitted in the interior rose, and an inner surface of the interior rose is contacted with an outer surface of the inner plate; and the notches of the interior rose is corresponding to the notches of the inner plate.

4. The door lock as claimed in claim 1, wherein a protruding piece perpendicular to a body surface of the inner plate is formed on the lower portion of the inner plate and passes through the opening of the stop plate.

5. The door lock as claimed in claim 1, wherein a back cylinder of the stop seat includes a protrusion for restricting the axial movement of the rotating spring.

6. The door lock as claimed in claim 1, wherein the hollow portion of the stop seat is assembled with a positioning surface of the revolving axis of the turning switch.

7. The door lock as claimed in claim 1, wherein the stop plate comprises a bulge on the surface contacted with the inner plate, and the inner plate comprises two indentations arranged in vertical direction and corresponding to the bulge; before the stop plate is pressed, the bulge of the stop plate is engaged with the higher indentation; after the stop plate is pressed to be engaged with the stop seat, the bulge of the stop plate is engaged with the lower indentation.

8. The door lock as claimed in claim 1, wherein the both ends of the stop plate are respectively bended to form a horizontal pressing surface.

9. The door lock as claimed in claim 8, wherein each of the horizontal pressing surfaces is covered with a rubber cover.

10. The door lock as claimed in claim 1, wherein the two side edges of the protruding block of the stop seat are formed with two ends, which are a first assembling point and a second assembling point.

11. The door lock as claimed in claim 1, wherein the sprag is in a "C" shape.

* * * * *